US008490898B2

(12) United States Patent
Pirrie

(10) Patent No.: US 8,490,898 B2
(45) Date of Patent: Jul. 23, 2013

(54) SPRAY ELECTRODE

(75) Inventor: Bruce Alastair Pirrie, Oxford (GB)

(73) Assignee: Atrium Innovation, Limited, London (GB)

( * ) Notice: Subject to any disclaimer, the term of this patent is extended or adjusted under 35 U.S.C. 154(b) by 771 days.

(21) Appl. No.: 10/552,272

(22) PCT Filed: Apr. 1, 2004

(86) PCT No.: PCT/GB2004/001431

§ 371 (c)(1),
(2), (4) Date: Mar. 26, 2007

(87) PCT Pub. No.: WO2004/089552

PCT Pub. Date: Oct. 21, 2004

(65) Prior Publication Data

US 2008/0283636 A1 Nov. 20, 2008

(30) Foreign Application Priority Data

Apr. 7, 2003 (GB) ..... 0308021.5

(51) Int. Cl.
*B05B 5/00* (2006.01)
*F23D 11/32* (2006.01)

(52) U.S. Cl.
USPC ..... 239/698; 239/707; 239/699

(58) Field of Classification Search
USPC ..... 239/690, 698, 699, 706, 707
See application file for complete search history.

(56) References Cited

U.S. PATENT DOCUMENTS 3,735,925 A * 5/1973 Benedek et al. ..... 239/704
4,431,137 A * 2/1984 Prewett et al. ..... 239/690
4,488,045 A * 12/1984 Anazawa et al. ..... 250/423 R
4,788,016 A * 11/1988 Colclough et al. ..... 264/10
4,801,086 A * 1/1989 Noakes ..... 239/3
4,830,872 A * 5/1989 Grenfell ..... 427/472
6,776,844 B2 * 8/2004 Yonekura et al. ..... 118/621

* cited by examiner

*Primary Examiner* — Len Tran
*Assistant Examiner* — Justin Jonaitis
(74) *Attorney, Agent, or Firm* — Ted Sabety, Esq.; Sabety and Associates, PLLC

(57) ABSTRACT

An electrostatic spraying device comprises a capillary spray electrode having a spraying end, a reference electrode, and a reservoir in fluid communication with the spray electrode. In use, the electrodes are connected across a generator in order to establish an electric field between the electrodes and cause fluid in the reservoir to be sprayed from the spray electrode. The spray electrode has a focus that defines a point at which the electric field is focussed on the spraying end.

6 Claims, 5 Drawing Sheets

SPRAY ELECTRODE

Figure 1A:
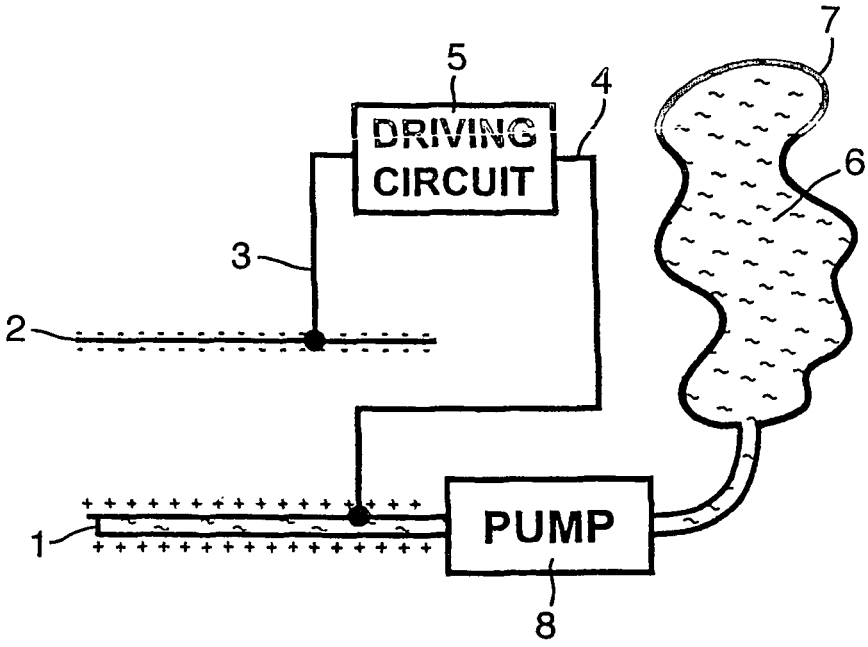

This application is a National Stage of Application No. PCT/GB2004/001431, filed Apr. 1, 2004, which claims priority to British Application No. GB 0308021.5, filed Apr. 7, 2003.

This invention relates to an electrostatic spraying device for the atomisation and vaporization of chemicals through the generation of a high specific surface of a liquid and to a spray electrode for use in such a device. It further relates to a method of manufacturing such an electrode and to a method for cleaning the electrode and a device for performing the method.

WO 03/00431 describes one such device that can be used to generate atomised droplets of a liquid that are electrically discharged, and which do not deposit on the device itself. This is an extremely efficient system.

It is important to control the electric field accurately, including the field created by the space charge of droplets and any ions. Therefore, it is also important to be able to predict the direction and spread of a liquid emitted from the spray electrode, and this must be consistent from one liquid to another. Some liquids form what are known as multiple jets, where more than one jet of liquid is formed at the spray electrode as described by Cloupeau and Prunet-Foch; *J Electrostatics;* 22 (1989) 135-159. The formation of these jets is difficult enough to predict for a single liquid, but over a range of different liquids with different properties there is little consistency at all. This means that a device would have to be set up specifically for each and every formulation, which is impractical for many applications.

Multiple jets are formed when a single jet can no longer sustain the whole flow rate and there is sufficient space and strength of electric field for additional jets to be formed. With the most common spray electrodes, formed from capillaries cut perpendicular to their axis, this means that the jet moves from a co-axial location where the field is strongest to the rim of the capillary where is it weaker. If this is still not sufficient to maintain the flow of liquid a second jet is formed at a diametrically opposite location on the rim of the capillary, as described by Jaworek & Krupa; *J. Aerosol Sci.* 7 (1996): 979-986.

The number of jets is very difficult to determine unless all aspects of the electric field within the device are known. This means that the electrical set-up, such as the geometry and voltage potential must be determined, along with the properties of the liquid and the flow rate of liquid to the nozzle, since these also effect the electric field. Such restrictions make the formation of multiple jets unhelpful in most commercial applications, and means to hinder or prevent the formation of multiple jets are extremely commercially advantageous.

This would seem to indicate that capillaries are therefore not the best form of spray electrode to use if multiple jets are not wanted. We have found, however, that with suitable modification they can be made to eliminate multiple jet formation.

According to one aspect of the invention there is provided an electrostatic spraying device comprising a capillary spray electrode having a spraying end, and a reference electrode, the electrodes being connected, in use, across a generator in order to establish an electric field between the electrodes and cause fluid in the capillary to be sprayed from the spray electrode, wherein the spray electrode has a focus that defines a point at which the electric field is focussed on the spraying end.

The invention causes the electric field to be focussed at one point on the spray electrode, so that the electric field there is sufficient to form a jet at the prominence, but is too weak elsewhere on the electrode for the formation of further jets. Furthermore, the electric field must be sufficiently focussed so that two or more jets cannot form at the focus, and it is therefore important that its shape creates only a single point at which the electric field is a maximum. Everywhere else the electric field should be much weaker.

The device described herein shows how by careful construction of the spray electrode and selection of its orientation with respect to the remainder of the device as well as its material composition, these problems may be overcome or reduced to acceptable levels. There are therefore provided a number of practical steps that pertain to both the causes and effects, which alone, or better still in combination, provide a more robust device that is less sensitive to formulation changes and whose performance is more consistent over long periods of use.

Descriptions of suitable geometries are provided later, but in one embodiment a local prominence or focus is provided at the tip of the spray electrode by means of a small amount of additional material to form a projection extending from a front surface of the spraying end in a direction parallel to the longitudinal axis of the spray electrode. The projection may be rounded with a radius of curvature less than that of the spray electrode itself.

Alternatively, the focus may be a rod adjacent the spray electrode and extending beyond a front surface of the spraying end in a direction parallel to the longitudinal axis of the spray electrode. The end of the rod may be rounded with a radius of curvature less than that of the spray electrode.

Another means to create a focus is to create a bevel on the exposed end of a capillary. In this embodiment, the spray electrode has a front surface at the spraying end, the front surface having rounded edges and being disposed at an oblique angle to the longitudinal axis of the spray electrode, thereby providing the focus. Typically, the front surface lies substantially in a plane.

Advantageously, the spray electrode is coated in a layer of dielectric or semiconductor material. This can be helpful in attenuating corona as will be described below.

Although there are some examples of 'teeth' and other such features provided in, for example, U.S. Pat. No. 5,503,335 and U.S. Pat. No. 5,927,618 these cannot be used since they actually create a plurality of localised electric field maxima. By contrast, the spray electrodes described herein have, by design, only one point of maximum electric field, and are shaped so as to inhibit the formation of multiple jets at the local prominence.

The orientation of the focus relative to the reference electrode may be specified depending on the application and the design of the device. We have found that various orientations are useful in different circumstances, since any ions created at the spray electrode should aid the spray process.

Where there are discharging ions present, it is preferable that the focus defines a point on the spray electrode closest to the reference electrode. Alternatively, the focus may define a point on the spray electrode midway between the points furthest from and closest to the reference electrode. In these cases any ions produced at the spray electrode help keep the system stable, by annihilating the discharging ions and in the case of a device as described in WO 03/00431, these ions help keep the spray away from the device itself. However, placing the focus at the strongest part of the electric field can sometimes also bring on excessive corona, but this can be attenuated by coating the spray electrode as described below.

The consequence of ions is that, in some cases, they cause gradual degradation of the spray electrode itself. This can be exacerbated by the liquid being sprayed, if it has a corrosive nature. Such corrosion generally results in a change of the shape of the spray electrode as the products of the corona attack it. In this respect it is best for the focus not to define a point closest to the reference electrode, since this point then is attacked first, and the changes in geometry that take place have a significant impact on the electric field and hence the spray behaviour. When the focus defines a point on the spray electrode midway between the points furthest from and closest to the reference electrode, such effects are reduced, and this is often the preferred orientation.

The least favourable position in these situations is when the focus defines a point or the spray electrode furthest from the reference electrode, since the spray droplets move inside the path of the ions and must cross it to exit the device. This leads to unwanted instabilities.

If, however, the reference electrode is not producing ions, but simply acting as a counter electrode, it is best if the focus defines a point on the spray electrode furthest from the reference electrode, since the droplets are then encouraged to follow a longer path between the spray electrode and the reference electrode, which is usually preferable in such cases except when the spray is being used to coat the reference electrode, such as for paint.

In accordance with a second aspect of the invention, there is provided a spray electrode for use with the electrostatic spraying device of the first aspect.

According to a third aspect of the invention, there is provided a method of manufacturing a spray electrode, the method comprising cutting or grinding a capillary at an oblique angle to the longitudinal axis of the capillary to form a spray end, and etching the spray end in order to round its edges.

The angle and finish of the bevel is important. For instance, forming a conventional bevel by grinding across the end is ineffective since this forms an edge like a hypodermic needle, which is far too sharp and acts not to focus the electric field to a point, but instead along the line of this 'knife-edge'. This is not effective for attenuating multiple-jet formation, since jets may easily form along the 'knife-edge'. Furthermore, a sharp edge created in this way increases the probability of excessive corona and this leads to inefficient use of the electrical power.

Instead it is necessary to round off the edge of a bevelled capillary spray electrode so that its radius of curvature is limited to a minimum of around 5 μm, and 10-30 μm being preferable.

We have found that chemical etching provides an ideal means of creating the required curvature and creates an even finish. The preferred chemical etchants used depend on the material of the spray electrode. Indeed, the material of the spray electrode itself is also important, since, for instance, coarse grain metals etch to a rough surface whereas more homogenous materials form smoother surfaces, which is advantageous.

The invention also provides means for attenuating corona which also act as a source of uncertainty in the design of electrostatic spray devices. This may be achieved by modifying the surface of the spray electrode, for example by creating a conformal coating over the spray electrode, the conformal coating having a low conductivity (for example, a dielectric or semiconductor material), and deposited using chemical, electrochemical or vapour deposition. Alternatively, the surface layers of the electrode itself can be modified to reduce its conductivity. For example, with an aluminium spray electrode by increasing the oxide layer by anodising.

We have discovered through the course of experiment using the device described in WO 03/00431 and others like it, that certain chemicals react with spray electrodes during extended use, and in some cases this can lead to spray electrode degradation and spray electrode blockage. This can be particularly problematic if the device is intended for long periods of use without servicing or observation.

Such problems are generic to all electrostatic spray devices where the spray electrode or spray electrode tip is situated during use in a strong electric field. Examples of other devices that would suffer in such circumstances include those described in WO92/15339, U.S. Pat. No. 5,337,963 and GB7814967. For devices such as these, and others like them or based on them, the electric field can catalyse or be the direct cause of chemical degradation, either in conjunction with the spray electrode or independently.

Practical observation has indicated that some organic molecules, including some that are used in fragrances, have reacted to form solid residues at the tip of the spray electrode, and in some cases this has contributed to a gradual reduction in the performance of the device over time. Even the degradation of molecules to a lesser degree is undesirable, since for example a fragrance's character may change or an active molecule used for health reasons could become less potent or be rendered ineffective. It is possible to simply leave out from spray formulations such problematic compounds or delicate molecules, but this is limiting.

Since the use of electric fields to generate droplets is desirable due to the performance and efficiency of such devices, it is important to reduce any deleterious effects of the electric field, such as chemical reactions, and to moderate or eliminate the consequences of such effects. Practical observation has shown that these chemical reactions are exacerbated by the presence of corona, so that attenuating the breakdown of air around the spray electrode limits these reactions and their effects. Therefore, to control corona, or at least to attempt to limit its occurrence to predetermined areas of a device it is essential to have a robust spray system with consistent performance.

According to a fourth aspect of the invention, there is provided an electrostatic spraying device comprising a capillary spray electrode having a spraying end, and a reference electrode, the electrodes being connected, in use, across a generator in order to establish an electric field between the electrodes and cause fluid in the capillary to be sprayed from the spray electrode, wherein the device further comprises a mechanism for applying a pulsed pressure wave to the fluid as it is sprayed from the spray electrode, thereby cleaning the spray electrode.

According to a fifth aspect of the invention, there is provided a method for cleaning a capillary spray electrode, the method comprising applying a pulsed pressure wave to a liquid that is sprayed through the electrode in use, thereby cleaning the spray electrode.

It is helpful to reduce the build up of deposits within the spray electrode itself. Although by inhibiting the formation of multiple jets one can increase flow rate and so better 'clear' the spray electrode, additional clearance may be required.

By applying a pulsed pressure wave to the fluid, the probability of build up inside the electrode is reduced. This is particularly useful with less viscous liquids where the viscous boundary layer at the inside surface of the electrode is small.

In some cases, where a single dose of liquid is required, this can be contained in the capillary. Typically, however, the device further comprises a reservoir in fluid communication with the spray electrode.

There now follows a description of the invention by way of example, with reference to the accompanying drawings, in which:—

Figure 1B:
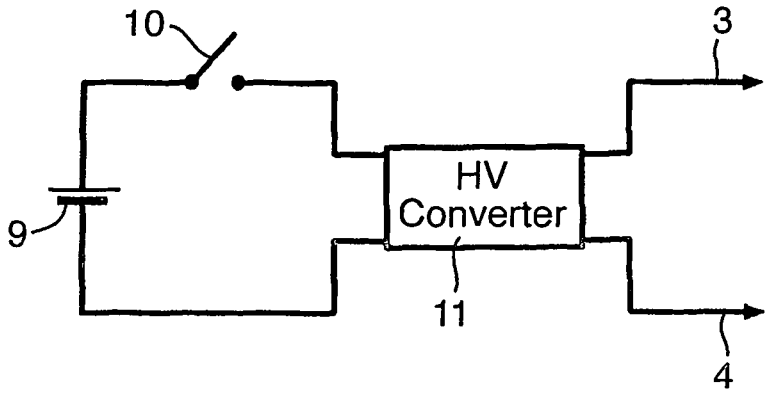
Figure 2A:
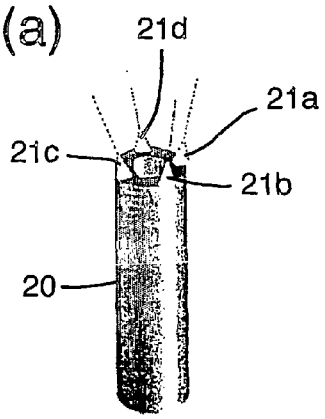
Figure 2B:
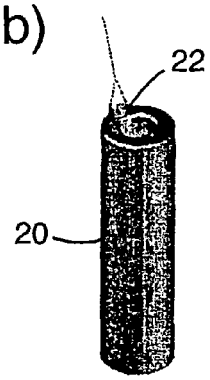
Figure 2C:
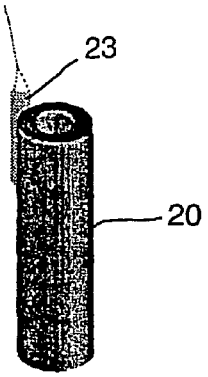
Figure 2D:
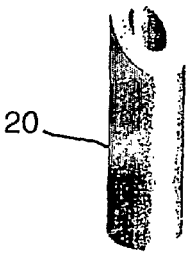
Figure 2E:
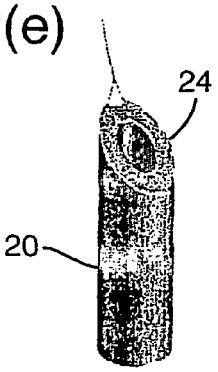
Figure 2F:
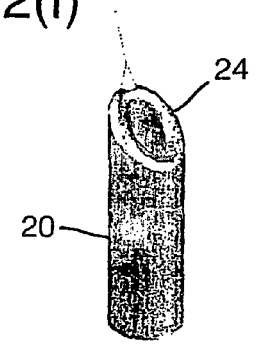
Figure 3A:
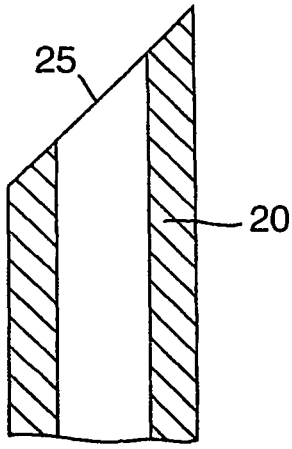
Figure 3B:
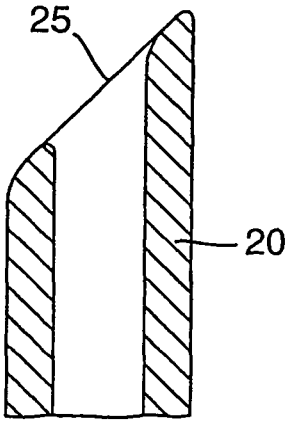
Figure 3C:
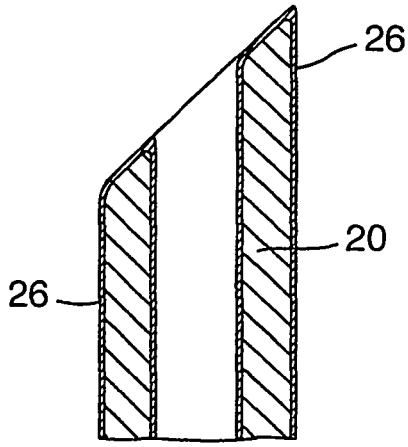
Figure 4A:
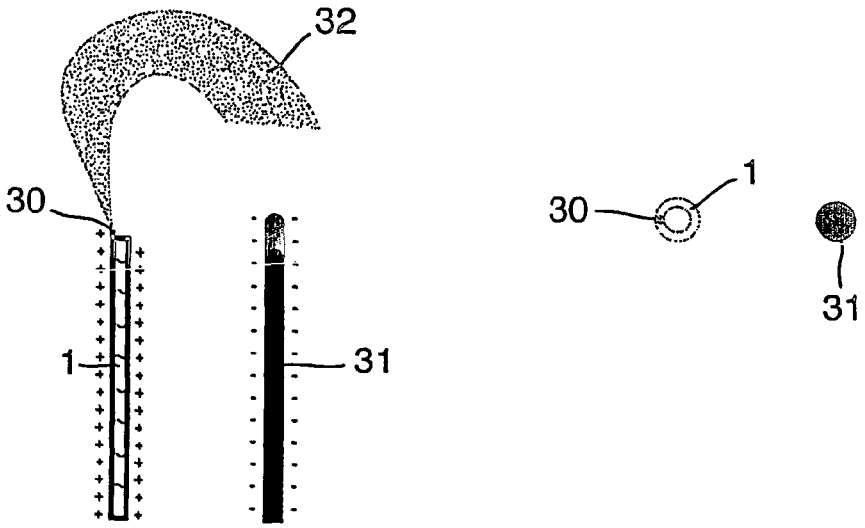
Figure 4B:
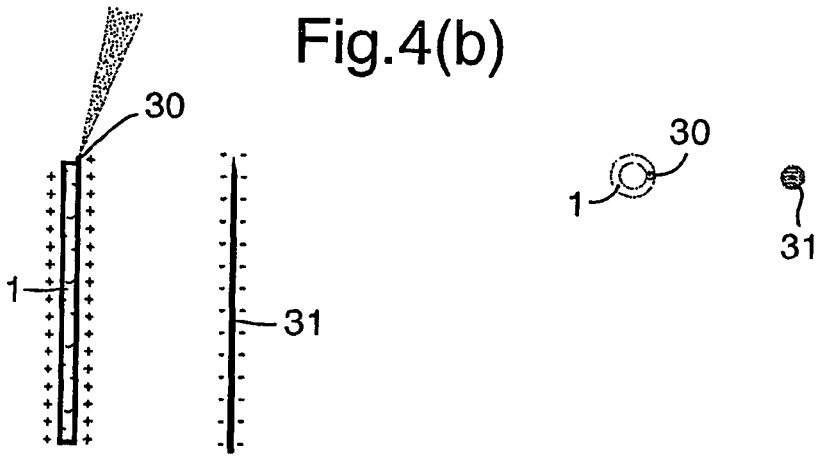
Figure 4C:
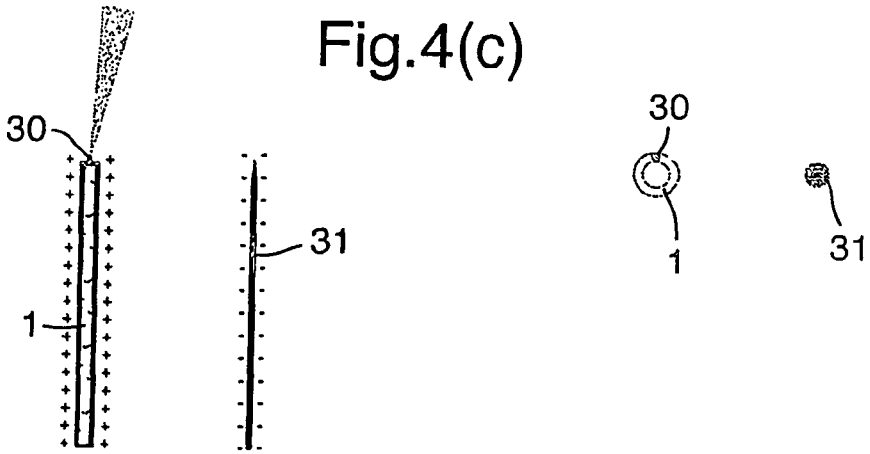
Figure 5:
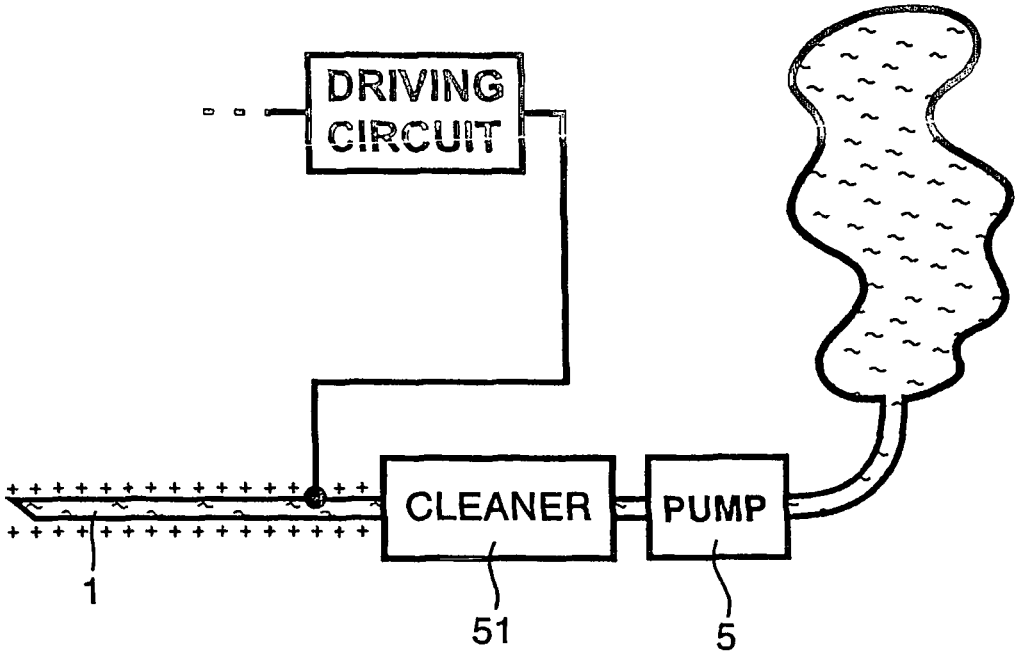
Figure 6:
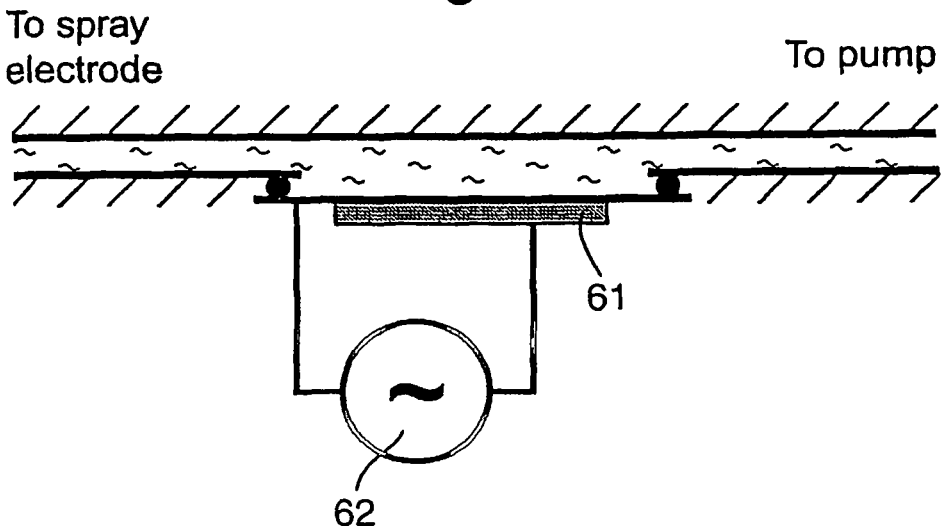

FIGS. 1(*a*) and 1(*b*) illustrate an example configuration of electrodes embodying this invention and the elements required to create a working device;

FIGS. 2(*a*) to 2(*f*) illustrate schematically various different electrode treatments, giving examples of both good and bad practice;

FIGS. 3(*a*) to 3(*c*) illustrate schematically cross-sectional views of the tips of three electrodes, again providing examples of both good and bad practice;

FIGS. 4(*a*) to 4(*c*) illustrate schematically various orientations of the spray electrode as described in the present invention;

FIG. 5 illustrates schematically a part cross-sectional view of one means for cleaning the spray electrode according to the present invention; and, FIG. 6 shows a cross-sectional view of one means of creating an integral spray electrode cleaning system.

FIG. 1(*a*) illustrates schematically one possible embodiment of the present invention, where there is a spray electrode 1, and a reference electrode 2 that can also be a discharging electrode. The spray electrode 1 in this example comprises a 27-gauge, conductive capillary, such as an aluminium capillary, and the reference electrode is any conducting surface, such as a stainless steel sheet or pin.

Electrical connections 3 and 4 are made between the electrodes and a driving circuit 5, which delivers a high voltage with a constant or regulated current when activated. Liquid 6, held in a flexible reservoir 7 made from A PET film or laminate, such as from a Mylar® laminate film manufactured by Dupont of Dupont Building, 1007 Market Street, Wilmington, Del. 19898, USA, is simultaneously pumped along the spray electrode 1 by the pump 8. A suitable pump would be one such as described in U.S. Pat. No. 5,961,298, but any means of pumping liquid would be sufficient. The liquid is broken up into droplets by the electric field, which are sprayed, charged or discharged depending on the nature of the reference electrode 2.

Where just a single dose of liquid is required, and that dose can be entirely held in the capillary and any tube attached to it, the pump and reservoir can be omitted. Such a configuration could have application for the delivery of a specific dose of pharmaceutical drug and such like.

FIG. 1(*b*) illustrates diagrammatically one possible electrical circuit embodying the invention for driving the device in FIG. 1(*a*). A battery or other low-voltage power source 9 is connected via a control switch 10 to the input of a high-voltage converter 11. The output terminals of the converter are connected to the electrical conduits 3 and 4 of the device in FIG. 1(*a*).

A simple converter for the device is a PSM10-103P manufactured by HiTek Power, Durban Road, Bognor Regis, West Sussex, PO22 9RL, UK. Note that any converter capable of delivering voltages from 1 to 30 KV at roughly 10 μA or less is suitable for this device. Higher power converters can also be used although they provide no added benefit and generally require more safety management. Low power devices, such as piezoelectric crystals or converters are ideal, and have distinct benefits such as reduced size and improved intrinsic safety.

It should be noted that there is no earth reference shown in the figure. This is deliberate since, for operational purposes, an earth reference can be omitted altogether or applied to any point in the circuit. In some cases, however, the application may require one for other purposes. The polarity of the high voltage output is also immaterial, although some rearrangement of the electrodes may be necessary, and for instance a PSM10-103P converter can be replaced by a PSM10-103N, (its negative counterpart), for a functioning device.

FIGS. 2(*a*) to 2(*f*) show six variations of the tip of the spray electrode 1, where FIG. 2(*a*) illustrates a standard conductive capillary 20 such as described in the art. In these examples the external diameter of the capillary is approximately 400 μm and the internal diameter is approximately 200 μm, i.e. the capillary is 27 gauge, although other gauges from 30 gauge and less are possible and the features would be scaled accordingly.

The capillary 20 in FIG. 2(*a*) produces multiple jets 21*a*-21*d* if the flow rate of liquid through the capillary 20 is high and the electric field around the tip is sufficiently strong. If the liquid cannot flow through a single jet sufficiently fast, second, third or multiple jets are formed at the tip.

Although under some circumstances this may be desirable, if control over the path of the droplets is required the unpredictable formation of multiple jets causes serious problems. Therefore means to hinder or prevent the formation of multiple jets are extremely commercially advantageous.

One means proposed here involves the creation of a focus or focal prominence as a focussing point for the electric field, so that although a capillary may act as the final conduit of liquid to the tip of the spray electrode, the liquid does not spray off its end perimeter. The purpose of the focal prominence is to reduce the potential required to produce a spray by increasing the local electric field at a single point. This is achieved by for example the addition of a small projection 22 at the end of the capillary 20 as illustrated in FIG. 2(*b*), or by an additional rod 23, of smaller outer diameter than the capillary itself, fixed to the end of the capillary 20 and substantially parallel to it, as illustrated in FIG. 2(*c*). In this later case the liquid travels over the end face of the capillary 20 and onto the rod 23 by surface tension forces of the liquid.

Note that the edges of the nozzles in FIGS. 2(*b*) and (*c*) must have a slight radius and not be sharp, otherwise second, third or more jets may form at the end of the capillary 20 diametrically opposite to the prominence 21 or rod 23.

A focal prominence may also be obtained by cutting a capillary 20 at an angle as illustrated in FIG. 2(*d*). However, this alone is not sufficient. A radius must also be applied to the edge 24 as shown in FIGS. 2(*e*) and (*f*), where the radius ranges from 5 to 50 μm. Such radii are difficult to obtain by mechanical means, and if they are this leads inevitably to inconsistencies that provide additional local focal points in the electric field, which then form potential sites for multiple jets. It is therefore a feature of this invention that no such extra focal prominences are created. There should be only one at the point of maximum electric field.

It should be noted that the larger the radius applied to the edge of the front surface of the spray electrode 1 the more acute the angle of bevel may be. When a minimum 5 μm radius is applied to the edge of the front surface of the spray electrode 1, for instance, the angle may be up to 60° or 70°. Whereas if it is 50 μm the angle may be as low as 30° or 20°. Angles outside this range may be used, but their benefits appear greatest in between these values.

FIG. 3(*a*) is a cross-sectional view through a capillary 20 with a focus provided by a bevel. The capillary 20 is roughly 27 gauge, although other gauges are possible but the features should be adjusted accordingly. Processing to this level is not sufficient to inhibit multiple jets and corona formation. Firstly, as the edge is so sharp, sometimes a nozzle like this will form two or more jets along the sharp, protruding edge 25. This is because in one direction, around the outer perimeter of the tip of the capillary 20, the radius of curvature is of the order of the capillary 20 itself, but in a perpendicular direction it can be of the order of the atomic size. This means that a capillary 20 like this acts as a sharp 'knife-edge', along which multiple jets may form.

Consequently, further modification of the capillary is required, to reduce the smallest radius of curvature, as illustrated in FIG. 3(*b*). Here the sharpest parts of the edge of the front surface 25 have been etched away by means of suitable chemicals. For instance, stainless steel electrodes may be etched by solutions of ferric chloride, hydrochloric acid, nitric acid or citric acid, for example, or a combination of these. Brass or copper based capillaries may be etched by ferric chloride solution or chromic-sulphuric acid mixtures. Aluminium capillaries may be etched by warm sodium hydroxide solutions or muriatic acid, for example.

Note that the concentration of the etchants and the etching time will depend on the material finish, such as surface roughness or the presence of machining lubricants, as well as its composition, granular structure and temper.

We have found a great deal of variation even for materials with apparently identical specifications, so it is recommended that tests be carried out on batch samples to determine the concentrations and etch times in every case. However, for the purposes of illustration, a 27 gauge capillary of 304 stainless steel may be etched by 50% volume solution of concentrated nitric acid in water over 5 minutes. It is helpful to keep the etching time to the order of 5-10 minutes, so that the time required to first add the pieces and then rinse them after treatment does not become critical. Longer times are unnecessary and may be reduced by using a more concentrated solution, whilst conversely fast etch times may be made longer by reducing the concentration of the etchant.

It should be noted that by eliminating sharp edges in this way, excessive corona may also be prevented. Although corona are not always a problem, they are a source of electrical inefficiency. Only a very small number of ions are required to discharge the droplets—usually less than 1 μA. So corona with currents much higher than this only increase the power required by the spray unit, but do not enhance its functionality.

FIG. 3(*c*) illustrates a capillary 20 modified in this way that has further been coated in a thin layer 26 of dielectric or semi-conductor. Such treatment inhibits the local formation of corona and can keep the power consumption down.

Once a capillary has be suitably modified in the ways described above it then acts as a source for a single spray. Modifications that focus the electric field on one side or the other mean that the orientation of the capillary with respect to a second or reference electrode become significant.

FIG. 4(*a*) illustrates how by placing the focus or focal prominence 30 at a point on the spray electrode 1 furthest from the second electrode 31 the path of charged droplets 32 may be increased. If the focus 30 were placed at a point on the spray electrode 1 furthest from the second electrode 31 the charged droplets 32 would travel more directly from one side to the other. The arrangement of FIG. 4(*c*) has benefits, for instance, in the charged delivery of aromas, where the longer the charged droplets 32 are in the air the more they have evaporated before they inevitably land on the second electrode 31.

Discharging the charged droplets 32 stops them from travelling to the second electrode 31; and so in this case a lengthening of the spray path is less necessary. In this case, by placing the focus 30 at a point on the spray electrode 1 nearest to the second electrode 31 where the electric field is stronger, (being nearer the second electrode 31), its multiple jet attenuating properties are enhanced.

Where there is a chance that the latter orientation might induce excessive corona, the focal prominence 30 may be placed at a point on the spray electrode 1 midway between the points furthest from and closest to the second electrode 31, as illustrated in FIG. 4(*c*), or at some point between the extremes illustrated by FIGS. 4(*a*) and (*b*).

We have found that the break-down of the air around capillaries of this kind is often inevitable, although the degree of ionisation depends greatly on the shape of the spray electrode, the presence of a discharging electrode, and the flow rate of liquid. For example, lower flow rates (1 μl/s or less), and the presence of any discharging electrode each raise the probability of gas discharge or corona.

The effect of this ionisation or the products of the ionisation, lead to chemical reactions at the tip of the spray electrode 1. This is not really an issue for the liquid being sprayed, since it is replaced regularly, and so any degradation is insignificant and often undetectable. However, the spray electrode 1 itself is not replaced, and it can undergo gradual change over long periods of use.

We have found that there are various ways to overcome this degradation or to remove the products of such degradation before they impair the proper functioning of the electrode. One is to use a material for the spray electrode 1 that is not sensitive to such attack. Platinum or tungsten electrodes may be used for example or even aluminium. These are relatively expensive options compared with stainless steel, which is produced in a suitable capillary form for many medical and other uses.

Another means to counter the gradual build up of the products of nozzle and liquid degradation is to include in the liquid to be sprayed a chemical that slowly cleans the spray electrode 1. One such example is citric acid which may be used to slowly clean a brass or stainless steel electrode as it is used, or silicone oil to protect the surface.

Unfortunately, it is not always practical to use such chemicals since other compounds may be toxic in large doses by inhalation, for example. Instead, a method of integral ultrasonic cleaning may be used to dislodge any products of degradation. FIG. 5 shows how a cleaner unit 51 may be placed in-line between the pump 5 and spray electrode 1. The cleaner should comprise a means to add a high frequency pulse to the flow over the general flow to the spray electrode.

One means is to use a piezoelectric diaphragm 61, as shown in FIG. 6, in series with the pump and electrode (not shown). The diaphragm needs to be pulsated with an alternating voltage produced by an oscillator 62 at a frequency of anything from 1 kHz to 1 MHz. These figures are just guide lines and frequencies outside this range may also be used. However, lower frequencies may create fluctuations in droplet diameter at the outlet, and higher frequencies may have negligible effect on liquids which are either extremely dense or viscous or both.

A suitable diaphragm is the 7BB-12-9 manufactured by MURATA ELECTRONICS (UK) LTD, Oak House, Ancells Road, Ancells Business Park, Fleet, Hampshire, GU51 2QW, United Kingdom. Since the build up of products due to degradation of the spray electrode 1 occurs over a relatively long period of time (days or weeks), it is only necessary to pulse the cleaner very occasionally. Usually once a day will be sufficient, and it is best to pulse it while the spray electrode 1 is spraying. However, if the cleaning process affects the quality of the spray it may be pulsed just before spraying is initiated; so any dislodged products are removed before they have time to settle.

Note that it is possible to use this kind of action also to pump the liquid as described in U.S. Pat. No. 5,630,709. The pump described therein has reciprocating parts that would impart some high frequency pulses to the general flow of liquid, which could be used to clean the spray electrode 1 while the device is spraying. In this case the pulses can be smaller in amplitude since they are applied all the time the device is spraying. Such a set-up has practical and commercial benefits since it combines two actions into one component, thus reducing the number of parts, making the device cheaper to manufacture.

An alternative to piezoelectric components is to use a multi-headed peristaltic pump, (such as the REGLO Digital MS-2/12 manufactured by ISMATEC SA, Labortechnik—Analytik, Feldeggstrasse 6, 8152 Glattbrugg, Switzerland), as the main pump 5 in FIG. 5. In this case there are already pulses superimposed on the main flow and this can be sufficient to clean the spray electrode 1. In this case the cleaner 51 and pump 5 are combined in a single component. However, large pulses may effect the quality of the spray, so this is better employed where precise control of the diameter of the droplets is not essential.

These steps for creating consistent performance from a spray device apply to all sorts of electrostatic devices, where strong electric fields exist around electrodes spraying a liquid. Examples include the dispersal of aromas, pest control agents or other compounds, such as for healthcare, pharmaceutical or other applications where inhalation is desired or required.

Examples of chemicals or mixtures thereof that can be used to clean the spray electrode 1 while it is spraying include liquid mixtures containing acids such as citric acid, nitric acid, muriatic acid, chromic acid, sulphuric acid, caprylic acid, cholic acid, decanesulfonic acid, deoxycholic acid, glycocholic acid, glycodeoxycholic acid, lauric acid, lauroylsarcosine, linoleic a linolenic acid, oleic acid, palmitic acid, palmitoleic acid, stearic acid, taurochenodeoxycholic acid, taurocholic acid, taurodehydrocholic acid, taurodeoxycholic acid, taurolithocholic acid, tauroursodeoxycholic acid, and salts thereof; alkalis such as sodium hydroxide; detergents such as phospholipids, polyoxyethylene ethers such as the "Brij®" series produced by ICI, (ICI, 20 Manchester Square, London, W1U 3AN, UK), ICI's "Synperonic®" series, ICI's "Tween®" series of non-ionic surfactants; and other compounds such as butylated hydroxyanisole, ferric chloride, ethanol, methanol, ether and isododecane; and compatible mixtures thereof.

Examples of compounds or products that could be used to protect the spray electrode 1 include surface active agents such as lauric acid, linoleic acid, linolenic acid, oleic acid, palmitic acid, palmitoleic acid, stearic acid; oils such as silicone oil, mineral oil; alcohols including methanol, ethanol; and compatible mixtures thereof.

Other applications and modifications thereof will be apparent to persons skilled in the art.

The invention claimed is:

1. An electrostatic spraying device comprising a capillary spray electrode comprising a conductive capillary comprised of a spraying end, a fluid conduit housed within the capillary that leads to the spraying end and a reference electrode, the conductive capillary spray electrode and the reference electrode being connected, in use, across a voltage source in order to establish an electric field between the electrodes that causes fluid passing through the conduit in the conductive capillary spray electrode to be sprayed from the spraying end of the conductive capillary spray electrode, wherein the tip of the conductive capillary spray electrode spraying end has a cross-section along its longitudinal axis that is rounded and has a focus that defines a point at which the electric field is focused on the spraying end, wherein the focus is provided by a projection extended from a front surface of the spraying end in a direction parallel to the longitudinal axis of the capillary spray electrode, the projection tip being rounded with a radius of curvature less than that of the capillary spray electrode.

2. An electrostatic spraying device comprising a capillary spray electrode comprising a conductive capillary having a spraying end, a fluid conduit housed within the capillary that leads to the spraying end and a reference electrode, the conductive capillary spray electrode and the reference electrode being connected, in use, across a voltage source in order to establish an electric field between the electrodes that causes fluid passing through the conduit in the capillary spray electrode to be sprayed from the spray electrode, wherein the tip of the conductive capillary spray electrode spraying end has a cross-section along its longitudinal axis that is rounded and is provided with a focus that defines a point at which the electric field is focused on the spraying end, wherein the focus is provided by a rod adjacent to the conductive capillary spray electrode and extending beyond a front surface of the spraying end of the conductive capillary spray electrode in a direction parallel to the longitudinal axis of the conductive capillary spray electrode, the end of the rod being rounded with a radius of curvature less than that of the conductive capillary spray electrode.

3. A device according to any of the preceding claims, further comprising a reservoir in fluid communication with the conductive capillary spray electrode.

4. The electrostatic spraying device of claim 1 or claim 2 where the projection is located external to the conductive capillary spray electrode.

5. The electrostatic spraying device of claim 1 or claim 2 where the radius of curvature of the tip of the conductive capillary spray electrode surface is greater than approximately 5 microns.

6. The electrostatic spraying device of claim 1 or claim 2 where the radius of curvature of the tip of the conductive capillary spray electrode surface is between approximately 10 microns and approximately 30 microns.

* * * * *